US008890787B2

(12) United States Patent
Cheng et al.

(10) Patent No.: US 8,890,787 B2
(45) Date of Patent: Nov. 18, 2014

(54) PANEL DRIVING DEVICE HAVING A SOURCE DRIVING CIRCUIT, AND LIQUID CRYSTAL DISPLAY APPARATUS HAVING THE SAME

(71) Applicant: ILI Technology Corporation, Jhubei (TW)

(72) Inventors: Chih-Kang Cheng, Hsinchu (TW); Sung-Yau Yeh, Jhubei (TW); Chih-Kang Deng, New Taipei (TW)

(73) Assignee: ILI Technology Corporation (TW)

( * ) Notice: Subject to any disclaimer, the term of this patent is extended or adjusted under 35 U.S.C. 154(b) by 129 days.

(21) Appl. No.: 13/740,068

(22) Filed: Jan. 11, 2013

(65) Prior Publication Data

US 2013/0194251 A1 Aug. 1, 2013

(30) Foreign Application Priority Data

Jan. 16, 2012 (TW) ..... 101101584 A

(51) Int. Cl.
*G09G 3/36* (2006.01)

(52) U.S. Cl.
CPC ..... *G09G 3/3648* (2013.01); *G09G 3/3688* (2013.01); *G09G 2320/0252* (2013.01)
USPC ..... 345/98; 345/100

(58) Field of Classification Search
CPC ..... G09G 2310/0291; G09G 3/3275; G09G 3/3611; G09G 2310/0275
USPC ..... 345/98, 100
See application file for complete search history.

(56) References Cited

U.S. PATENT DOCUMENTS

| | | | | |
|---|---|---|---|---|
| 6,154,192 | A * | 11/2000 | Katakura et al. | 345/98 |
| 7,764,259 | B2 * | 7/2010 | Wu et al. | 345/98 |
| 8,514,159 | B2 * | 8/2013 | Hirama | 345/89 |
| 2006/0214900 | A1 * | 9/2006 | Tsuchi et al. | 345/98 |
| 2007/0247408 | A1 * | 10/2007 | Nishimura et al. | 345/89 |
| 2007/0296679 | A1 * | 12/2007 | Fukuda et al. | 345/98 |
| 2009/0167666 | A1 * | 7/2009 | Min | 345/94 |
| 2009/0284317 | A1 * | 11/2009 | Lee | 345/204 |
| 2010/0156855 | A1 * | 6/2010 | Lee | 345/204 |

* cited by examiner

*Primary Examiner* — Kevin M Nguyen
(74) *Attorney, Agent, or Firm* — Kilpatrick Townsend & Stockton LLP

(57) ABSTRACT

A liquid crystal display (LCD) apparatus includes: multiple differential amplifier stages each of which is operable to generate, according to a bias current and an input voltage, an output voltage having a magnitude and a slew rate that correspond respectively to the input voltage and a magnitude of the bias current, and serving as a data voltage of a corresponding pixel unit of an LCD panel; multiple current sources controllable to generate and provide a plurality of the bias currents to the differential amplifier stages, respectively; and a bias voltage generating unit connected electrically to the current sources in a current mirror configuration for generating an input bias current and controlling the current sources to generate the bias currents according to a latch pulse signal. The slew rate of the output voltage corresponds to a logic state of the input bias current.

13 Claims, 6 Drawing Sheets

PANEL DRIVING DEVICE HAVING A SOURCE DRIVING CIRCUIT, AND LIQUID CRYSTAL DISPLAY APPARATUS HAVING THE SAME

CROSS-REFERENCE TO RELATED APPLICATION

This application claims priority of Taiwanese Application No. 101101584, filed on Jan. 16, 2012.

BACKGROUND OF THE INVENTION

1. Field of the Invention

The present invention relates to a panel driving device having a source driving circuit, and a liquid crystal display apparatus having the same.

2. Description of the Related Art

U.S. Pat. No. 8,018,282 discloses a conventional driving circuit for driving pixel capacitors of a liquid crystal display. The conventional driving circuit includes at least one bias voltage generator and a plurality of operational amplifiers 1 (see FIG. 1, only one operational amplifier 1 is shown).

The bias voltage generator is operable for generating a bias voltage. Each of the operational amplifiers 1 is connected electrically to the bias voltage generator for receiving the bias voltage therefrom, and is operable to generate a bias current according to the bias voltage received by the operational amplifier 1.

As shown in FIG. 1, each of the operational amplifiers 1 includes a current source 10 operable to provide an additional bias current for boosting a voltage slew rate of the operational amplifier 1. However, implementation of the current source 10 may increase chip dimensions and hence cost of the conventional driving circuit. In an application where the conventional driving circuit is operatively associated with a liquid crystal display with a resolution of 800 px by 600 px, since each pixel is associated with three colors (i.e., red, green, and blue), the conventional driving circuit includes a total of 2400 (800×3) operational amplifiers 1. In other words, the conventional driving circuit must be implemented with a total of 2400 current sources 10, which can be costly.

SUMMARY OF THE INVENTION

Therefore, an object of the present invention is to provide a liquid crystal display (LCD) apparatus that is capable of alleviating the aforesaid drawbacks of the prior art.

Accordingly, a liquid crystal display (LCD) apparatus of the present invention includes:

an LCD panel having a plurality of pixel units, each of which includes a pixel capacitor, and a thin-film transistor (TFT) having a source terminal disposed to receive a data voltage, a gate terminal disposed to receive a gate voltage, and a drain terminal connected electrically to ground via the pixel capacitor; and a panel driving device including a timing control circuit operable for generating a gate control signal and a latch pulse signal, a gate driving circuit connected electrically to the timing control circuit for receiving the gate control signal therefrom, operable to generate a plurality of the gate voltages according to the gate control signal received by the gate driving circuit, and further connected electrically to the LCD panel for providing each of the gate voltages to the gate terminal of the TFT of a respective one of the pixel units, and a source driving circuit including a plurality of data voltage generating units, each of which includes an operational amplifier including a differential amplifier stage that is disposed to receive a bias current and an input voltage, and that is operable to generate an output voltage according to the bias current and the input voltage received by the differential amplifier stage, the output voltage generated by the differential amplifier stage of the operational amplifier of each of the data voltage generating units having a magnitude that corresponds to the input voltage received by the differential amplifier stage, and a slew rate that corresponds to a magnitude of the bias current, the data voltage received by the TFT of each of the pixel units of the LCD panel corresponding to the output voltage generated by the differential amplifier stage of the operational amplifier of a corresponding one of the data voltage generating units, and a current source that is controllable to generate the bias current and that is connected electrically to the differential amplifier stage for providing the bias current thereto, and a bias voltage generating unit connected electrically to the timing control circuit for receiving the latch pulse signal therefrom, and to the operational amplifier of each of the data voltage generating units in a current mirror configuration for generating an input bias current and controlling the current source of the operational amplifier to generate the bias current according to the latch pulse signal received by the bias voltage generating unit.

The slew rate of the output voltage of the differential amplifier stage of the operational amplifier of each of the data voltage generating units is higher when the input bias current is at one of high and low logic states than when the input bias current is at the other of the high and low logic states.

Another object of the present invention is to provide a panel driving device capable of alleviating the aforesaid drawbacks of the prior art.

Accordingly, a panel driving device of the present invention is for use with a liquid crystal display (LCD) panel having a plurality of pixel units, each of which includes a pixel capacitor and a thin-film transistor (TFT) having a source terminal that is disposed to receive a data voltage, a gate terminal that is disposed to receive a gate voltage, and a drain terminal that is connected electrically to ground via the pixel capacitor. The panel driving device includes:

a timing control circuit operable for generating a gate control signal and a latch pulse signal;

a gate driving circuit connected electrically to the timing control circuit for receiving the gate control signal therefrom, operable to generate a plurality of the gate voltages according to the gate control signal received by the gate driving circuit, and adapted to be connected electrically to the LCD panel for providing each of the gate voltages to the gate terminal of the TFT of a respective one of the pixel units; and a source driving circuit including a plurality of data voltage generating units, each of which includes an operational amplifier including a differential amplifier stage that is disposed to receive a bias current and an input voltage, and that is operable to generate an output voltage according to the bias current and the input voltage received by the differential amplifier stage, the output voltage generated by the differential amplifier stage of the operational amplifier of each of the data voltage generating units having a magnitude that corresponds to the input voltage received by the differential amplifier stage, and a slew rate that corresponds to a magnitude of the bias current, the data voltage received by the TFT of each of the pixel units of the LCD panel corresponding to the output voltage generated by the differential amplifier stage of the operational amplifier of a corresponding one of the data voltage generating units, and a current source that is controllable to generate the bias current and that is connected electrically to the differential amplifier stage for providing the bias current thereto, and a bias voltage generating unit connected electrically to the timing control circuit for receiving the latch pulse signal therefrom, and to the operational amplifier of each of the data voltage generating units in a current mirror configuration for generating an input bias current and controlling the current source of the operational amplifier to generate the bias current according to the latch pulse signal received by the bias voltage generating unit.

The slew rate of the output voltage of the differential amplifier stage of the operational amplifier of each of the data voltage generating units is higher when the input bias current is at one of high and low logic states than when the input bias current is at the other of the high and low logic states.

Yet another object of the present invention is to provide a source driving circuit capable of alleviating the aforesaid drawbacks of the prior art.

Accordingly, a source driving circuit of the present invention is for use with a liquid crystal display (LCD) panel having a plurality of pixel units, each of which includes a pixel capacitor, and a thin-film transistor (TFT) having a source terminal that is disposed to receive a data voltage. The source driving circuit includes:

a plurality of data voltage generating units, each of which includes an operational amplifier including a differential amplifier stage that is disposed to receive a bias current and an input voltage, and that is operable to generate an output voltage according to the bias current and the input voltage received by the differential amplifier stage, the output voltage generated by the differential amplifier stage of the operational amplifier of each of the data voltage generating units having a magnitude that corresponds to the input voltage received by the differential amplifier stage, and a slew rate that corresponds to a magnitude of the bias current, the data voltage received by the TFT of each of the pixel units of the LCD panel corresponding to the output voltage generated by the differential amplifier stage of the operational amplifier of a corresponding one of the data voltage generating units, and a current source that is controllable to generate the bias current and that is connected electrically to the differential amplifier stage for providing the bias current thereto; and a bias voltage generating unit disposed to receive a latch pulse signal, and connected electrically to the operational amplifier of each of the data voltage generating units in a current mirror configuration for generating an input bias current and controlling the current source of the operational amplifier to generate the bias current according to the latch pulse signal received by the bias voltage generating unit.

The slew rate of the output voltage of the differential amplifier stage of the operational amplifier of each of the data voltage generating units is higher when the input bias current is at one of high and low logic states than when the input bias current is at the other of the high and low logic states.

According to another aspect of the present invention, a source driving circuit includes:

a plurality of data voltage generating units, each of which includes an operational amplifier disposed to receive an input voltage and operable to generate an output voltage that has a magnitude related to the input voltage, the operational amplifier including a cascade of amplifying circuits, each of the amplifying circuits including a current source that is operable for providing a bias current, the output voltage of the operational amplifier having a slew rate that corresponds to a magnitude of the bias current; and a bias voltage generating unit connected electrically to the current source of each of the amplifying circuits of each of the operational amplifiers in a current mirror configuration, and operable to generate an input bias current and to control generation of the bias currents of the current sources of the amplifying circuits according to a latch pulse signal.

A slew rate of the output voltage of each of the operational amplifiers is higher when the input bias current generated by the bias voltage generating unit is at one of high and low logic states than when the input bias current is at the other of the high and low logic states.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
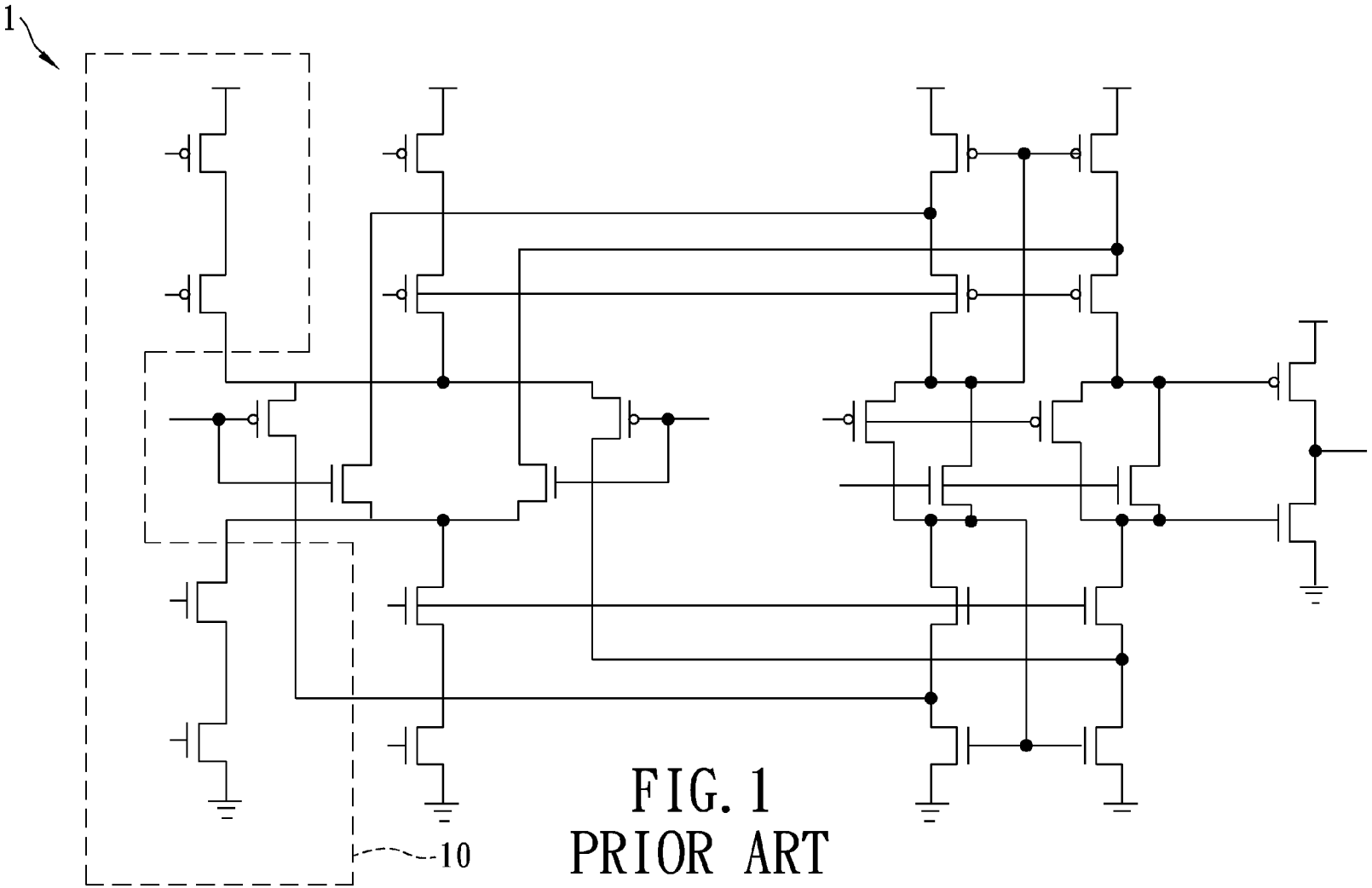
FIG. 1 PRIOR ART
FIG. 1 is a circuit diagram of an operational amplifier in a conventional driving circuit.

Before the present invention is described in greater detail, it should be noted that like elements are denoted by the same reference numerals throughout the disclosure.

Figure 2:
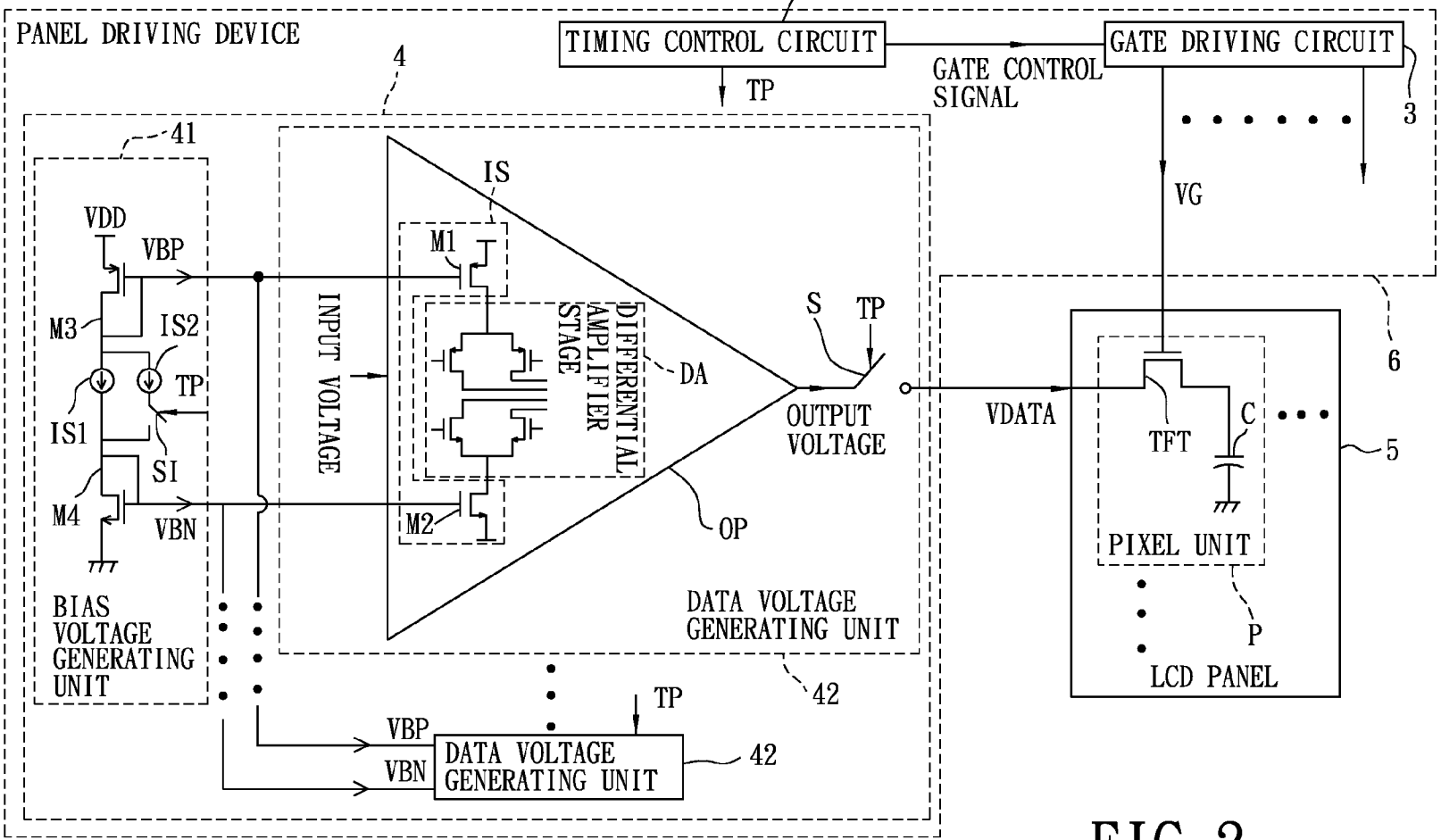
FIG. 2 is a circuit block diagram of the first preferred embodiment of a liquid crystal display apparatus according to the present invention.

Referring to FIG. 2, the first preferred embodiment of a liquid crystal display (LCD) apparatus according to this invention includes an LCD panel 5 and a panel driving device 6.

The LCD panel 5 includes a plurality of pixel units (P) (only one is shown in FIG. 2), each of which includes a thin-film transistor (TFT) and a pixel capacitor (C). The thin-film transistor (TFT) has a source terminal disposed to receive a data voltage (VDATA), a gate terminal disposed to receive a gate voltage (VG), and a drain terminal connected electrically to ground via the pixel capacitor (C).

The panel driving device 6 is operatively associated with the LCD panel 5, and includes a timing control circuit 2, agate driving circuit 3, and a source driving circuit 4.

The timing control circuit 2 is operable for generating a gate control signal and a latch pulse signal (TP).

The gate driving circuit 3 is connected electrically to the timing control circuit 2 for receiving the gate control signal therefrom, is operable to generate a plurality of the gate voltages (VG) according to the gate control signal received by the gate driving circuit 3, and is further connected electrically to the LCD panel 5 for providing each of the gate voltages (VG) to the gate terminal of the thin-film transistor (TFT) of a respective one of the pixel units (P).

The source driving circuit 4 includes a bias voltage generating unit 41 and a plurality of data voltage generating units 42, each of which includes an operational amplifier (OP) and a switch (S).

The operational amplifier (OP) of each of the data voltage generating units 42 has a non-inverting input terminal disposed to receive an input voltage, an inverting input terminal, and an output terminal connected electrically to the inverting input terminal, is operable to generate an output voltage for output via the output terminal, and includes a differential amplifier stage (DA) and a current source (IS).

The differential amplifier stage (DA) of the operational amplifier (OP) of each of the data voltage generating units 42 is disposed to receive a bias current and the input voltage, and is operable to generate the output voltage according to the bias current and the input voltage received by the differential amplifier stage (DA). The output voltage generated by the differential amplifier stage (DA) of the operational amplifier (OP) of each of the data voltage generating units 42 has a magnitude that corresponds to the input voltage received by the differential amplifier stage (DA), and a slew rate that corresponds to a magnitude of the bias current.

The data voltage (VDATA) received by the thin-film transistor (TFT) of each of the pixel units (P) of the LCD panel 5 corresponds to the output voltage generated by the differential amplifier stage (DA) of the operational amplifier (OP) of a corresponding one of the data voltage generating units 42.

The current source (IS) of the operational amplifier (OP) of each of the data voltage generating units 42 is connected electrically to the differential amplifier stage (DA) of the operational amplifier (OP), is controllable to generate the bias current for provision to the differential amplifier stage (DA), and includes first and second transistors (M1, M2). The magnitude of the bias current thus generated, and hence the slew rate of the output voltage, may be adjusted by controlling operation of the current source (IS).

For each of the data voltage generating units 42: the first transistor (M1) has a first terminal connected electrically to the differential amplifier stage (DA), a second terminal disposed to receive an input bias voltage (VDD), and a control terminal disposed to receive a first bias voltage (VBP) corresponding to the input bias voltage (VDD) from the bias voltage generating unit 41; and the second transistor (M2) has a first terminal connected electrically to the differential amplifier stage (DA), a grounded second terminal, and a control terminal disposed to receive a second bias voltage (VBN) from the bias voltage generating unit 41.

The switch (S) of each of the data voltage generating units 42 has a first terminal connected electrically to the differential amplifier stage (DA) of the operational amplifier (OP) of the data voltage generating unit 42 for receiving the output voltage therefrom, a second terminal connected electrically to the source terminal of the thin-film transistor (TFT) of the corresponding one of the pixel units (P) of the LCD panel 5, and a control terminal receiving the latch pulse signal (TP) from the timing control circuit 2. The switch (S) of each of the data voltage generating units 42 switches between conductive and non-conductive states according to the latch pulse signal received thereby such that the output voltage through the switch (S) serves as the data voltage (VDATA) of the corresponding one of the pixel units (P) of the LCD panel 5 when the switch (S) is in the conductive state.

The bias voltage generating unit 41 is connected electrically to the timing control circuit 2 for receiving the latch pulse signal (TP) therefrom, and to the operational amplifier (OP) of each of the data voltage generating units 42 in a current mirror configuration for generating an input bias current and controlling the current source (IS) of the operational amplifier (OP) to generate the bias current according to the latch pulse signal (TP) received by the bias voltage generating unit 41. The input bias current thus generated has high and low logic levels.

In the abovementioned current mirror configuration, the input bias current, and hence the bias current generated by the current source (IS) of the operational amplifier (OP) of each of the data voltage generating units 42, correspond to a first predetermined current when the input bias current is at the low logic level, and correspond to a sum of the first predetermined current and a second predetermined current when the input bias current is at the high logic level.

For each of the data voltage generating units 42, since the slew rate of the output voltage of the differential amplifier stage (DA) corresponds to the magnitude of the bias current generated by the current source (IS), the slew rate is higher when the bias current, which is substantially identical in magnitude to the input bias current, is at the high logic level than when the bias current is at the low logic level.

In this embodiment, the bias voltage generating unit includes third and fourth transistors (M3, M4), first and second current sources (IS1, IS2), and a current-boost switch (SI).

The third transistor (M3) has: a first terminal connected electrically to the control terminal of the first transistor (M1) of the current source (IS) of the operational amplifier (OP) of each of the data voltage generating units 42; a second terminal disposed to receive a terminal bias voltage (VDD); and a control terminal connected electrically to the first terminal of the third transistor (M3). A voltage at the first terminal of the third transistor (M3) serves as the first bias voltage (VBP).

The fourth transistor (M4) has: a first terminal connected electrically to the control terminal of the second transistor (M2) of the current source (IS) of the operational amplifier (OP) of each of the data voltage generating units 42; a grounded second terminal; and a control terminal connected electrically to the first terminal of the fourth transistor (M4). A voltage at the first terminal of the fourth transistor (M4) serves as the second bias voltage (VBN).

The current-boost switch (SI) has a first terminal, a second terminal connected electrically to the first terminal of the fourth transistor (M4), and a control terminal receiving the latch pulse signal (TP) from the timing control circuit 2, and is operable to switch between conductive and non-conductive states according to the latch pulse signal (TP).

The first current source (IS1) is connected electrically between the first terminal of the third transistor (M3) and that of the fourth transistor (M4), and serves to provide the first predetermined current.

The second current source (IS2) is connected electrically between the first terminal of the third transistor (M3) and the first terminal of the current-boost switch (SI), and serves to provide the second predetermined current.

When the current-boost switch (SI) switches to the conductive state, the first and second predetermined currents flow through the third and fourth transistors (M3, M4) such that the input bias current switches to the high logic level, causing a source-gate voltage of the third transistor (M3) and a gate-source voltage of the fourth transistor (M4) to increase, which, in turn, causes a source-gate voltage of the first transistor (M1) and a gate-source voltage of the second transistor (M2) of the current source (IS) of the operational amplifier (OP) of each of the data voltage generating units 42 to increase. Thus, when the input bias current is at the high logic level, the magnitude of the bias current generated by the current source (IS), and hence the slew rate of the output voltage generated by the differential amplifier stage (DA), of each of the data voltage generating units 42 increase relative to when the input bias current is at the low logic level.

In the present embodiment: each of the first and third transistors (M1, M3) is a p-type metal-oxide semiconductor field-effect transistor (MOSFET) having drain, source, and gate terminals that serve as the first, second, and control terminals of the transistor (M1, M3), respectively; and each of the second and fourth transistors (M2, M4) is an n-type MOSFET having drain, source, and gate terminals that serve as the first, second, and control terminals of the transistor (M2, M4), respectively.

Figure 3:
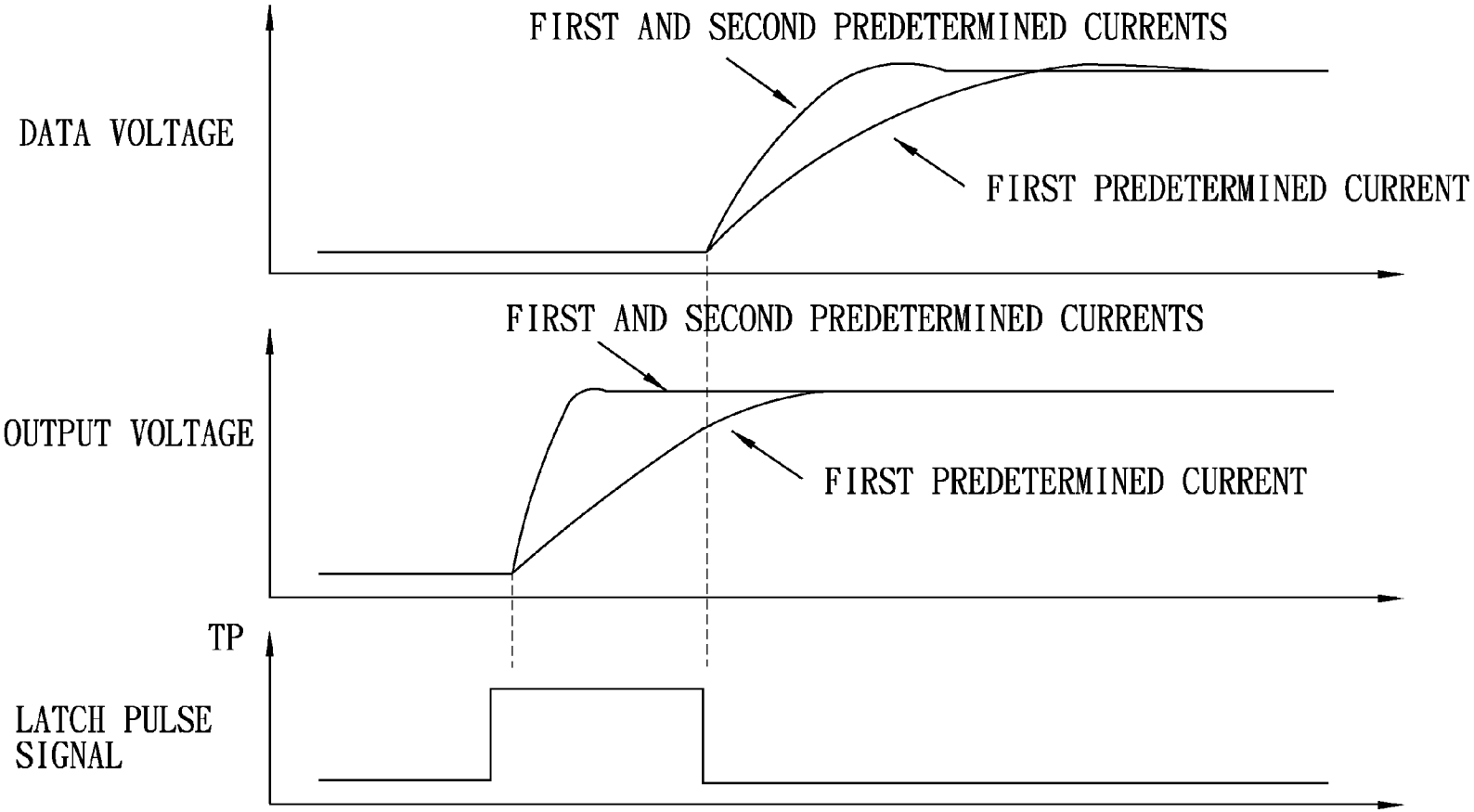
FIG. 3 is a timing diagram of the first preferred embodiment.

Referring to FIG. 3, the latch pulse signal (TP) has high and low logic levels corresponding respectively to those of the input bias current. When the latch pulse signal (TP) is at the high logic level, the switch (S) is in the non-conductive state, enabling generation of the output voltage at the output terminal. When the latch pulse signal (TP) is at the low logic level, the switch (S) is in the conductive state such that the operational amplifier (OP) is able to provide the output voltage through the switch (S).

Through comparing the curve corresponding to the first predetermined current with the curve corresponding to the sum of the first and second predetermined currents, it is apparent that the latter corresponds to a high slew rate relative to the former.

Figure 4:
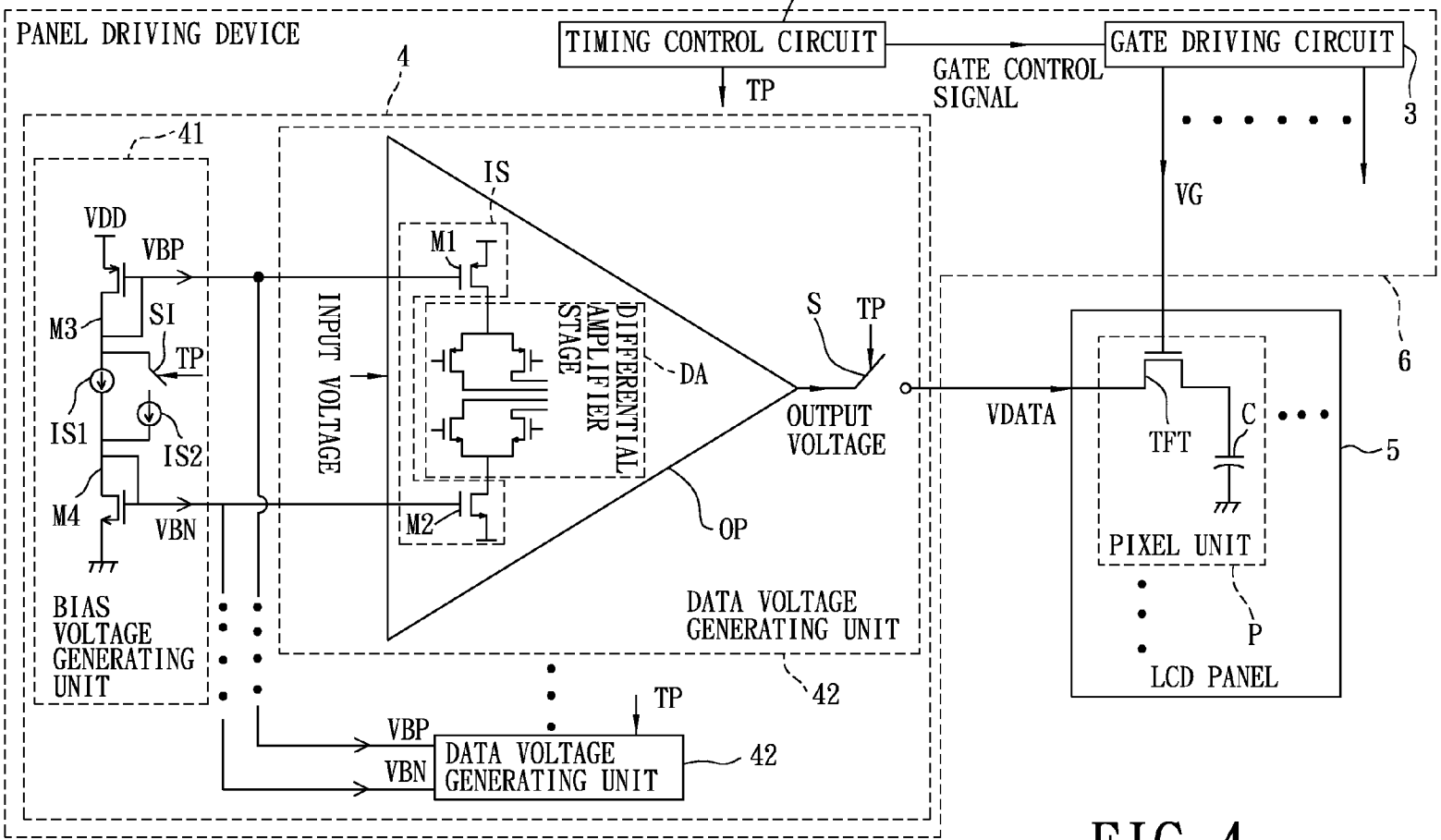
FIG. 4 is a circuit block diagram of the second preferred embodiment of a liquid crystal display apparatus according to this invention.

Referring to FIG. 4, the second preferred embodiment of an LCD apparatus according to this invention is shown to be similar to the first preferred embodiment. The difference between the first and second preferred embodiments resides in that, in the second preferred embodiment, the first terminal of the current-boost switch (SI) is connected electrically to the first terminal of the third transistor (M3), and the second current source (IS2) is connected electrically between the second terminal of the current-boost switch (SI) and the first terminal of the fourth transistor (M4).

Figure 5:
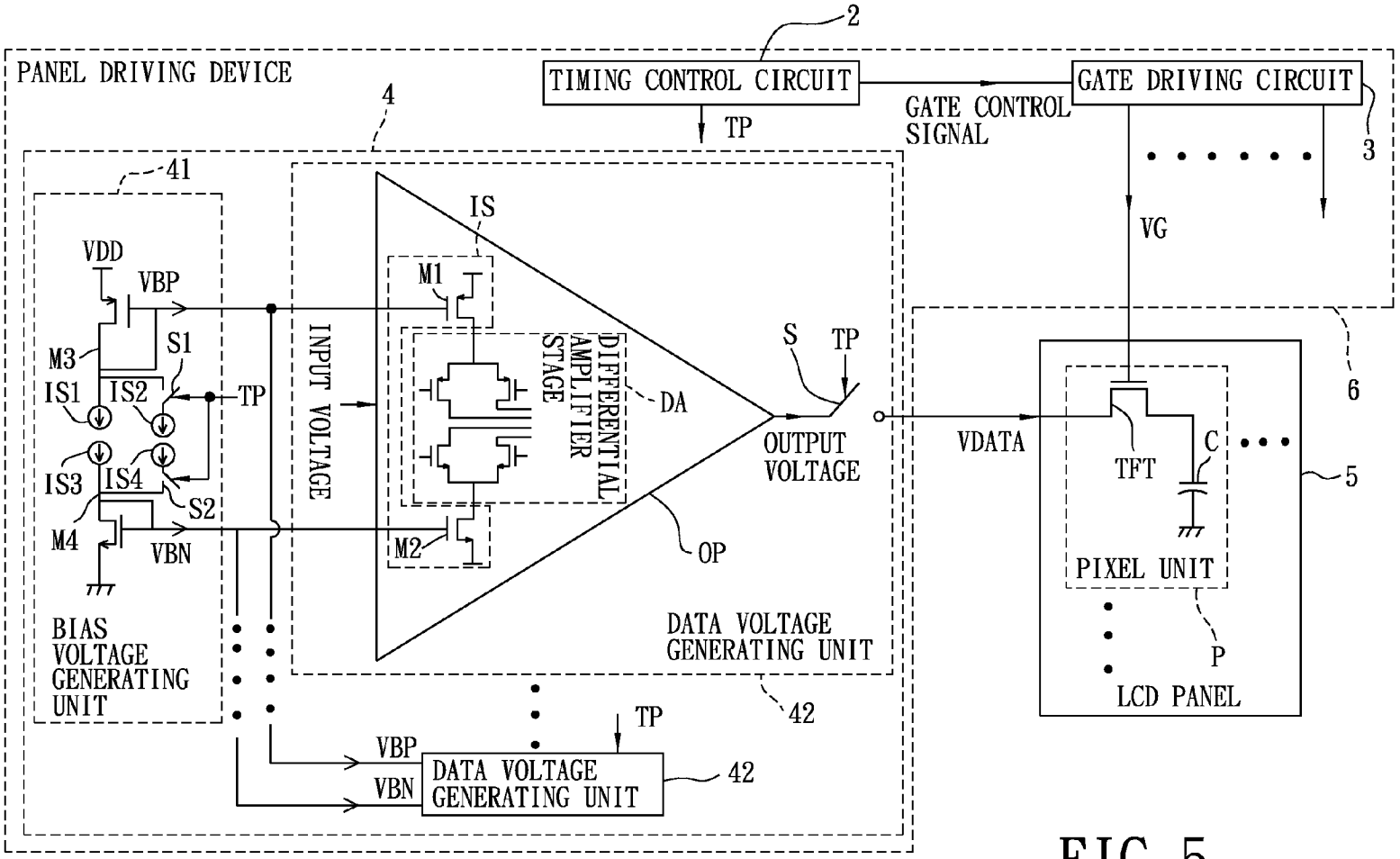
FIG. 5 is a circuit block diagram of the third preferred embodiment of a liquid crystal display apparatus according to this invention.

Referring to FIG. 5, the third preferred embodiment of an LCD apparatus according to this invention is shown to be similar to the first preferred embodiment. The difference between the first and third preferred embodiments resides in that, in the third preferred embodiment, the bias voltage generating unit 41 further includes third and fourth current sources (IS3, IS4), and a second current-boost switch (S2). For the sake of clarity, the current-boost switch (S) will hereinafter be referred to as the first current-boost switch (S1).

The first terminal of the first current-boost switch (S1) is connected electrically to the first terminal of the third transistor (M3), and the control terminal of the same is connected electrically to the timing control circuit 2 for receiving the latch pulse signal (TP) therefrom. The first current-boost switch (S1) switches between the conductive and non-conductive states according to the latch pulse signal (TP).

The second current-boost switch (S2) has a first terminal, a second terminal connected electrically to the first terminal of the fourth transistor (M4), and a control terminal connected electrically to the timing control circuit 2 for receiving the latch pulse signal (TP) therefrom. The second current-boost switch (S2) switches between conductive and non-conductive states according to the latch pulse signal (TP).

The first current source (IS1) is connected electrically to the first terminal of the third transistor (M3), and is operable for providing the first predetermined current through the third transistor (M3).

The second current source (IS2) is connected electrically to the second terminal of the first current-boost switch (S1), and is operable for providing the second predetermined current via the first current-boost switch (S1) through the third transistor (M3).

The third current source (IS3) is connected electrically to the first terminal of the fourth transistor (M4), and is operable for providing the first predetermined current through the fourth transistor (M4).

The fourth current source (IS4) is connected electrically to the first terminal of the second current-boost switch (S2), and is operable for providing the second predetermined current via the second current-boost switch (S2) through the fourth transistor (M4).

Figure 6:
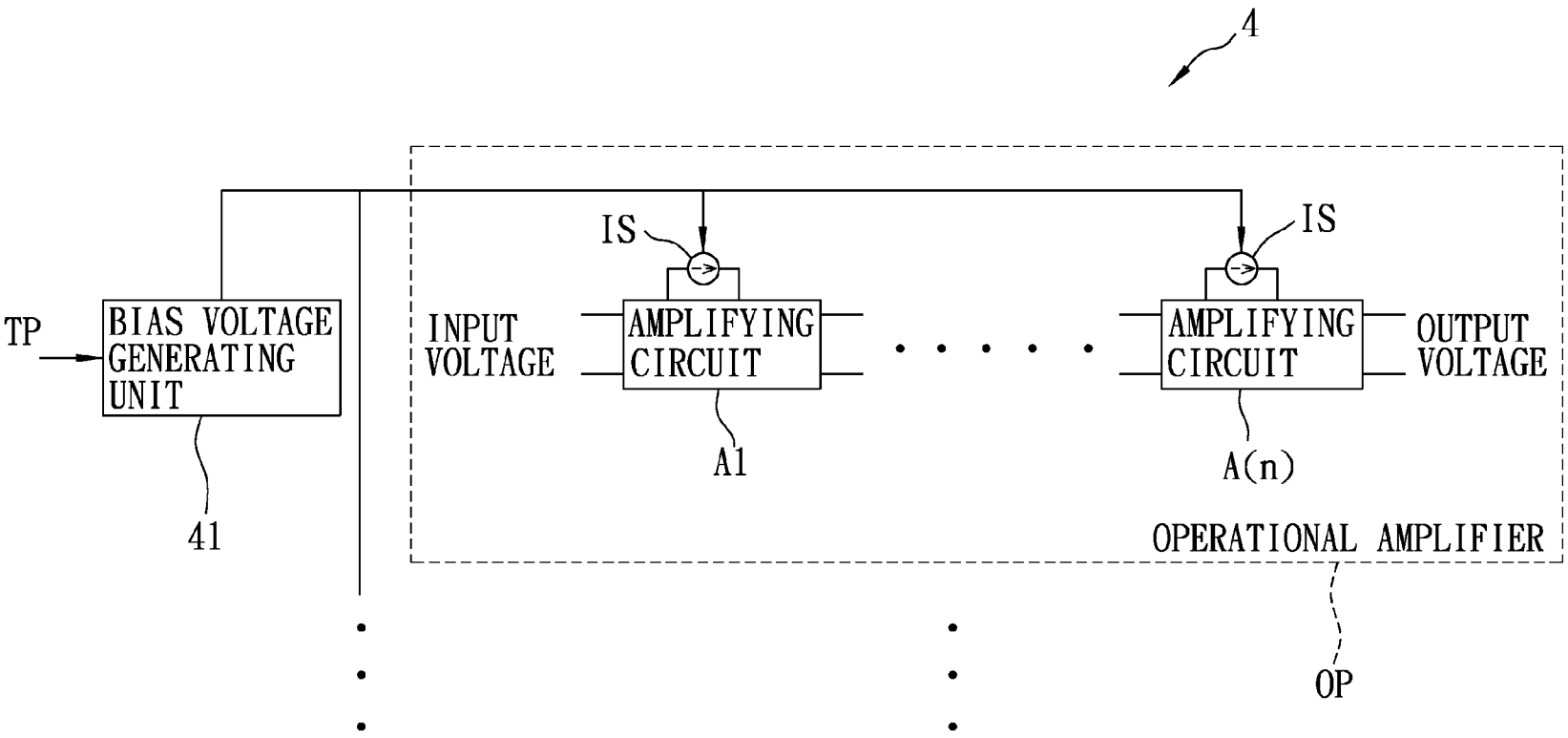
FIG. 6 is a circuit block diagram of the fourth preferred embodiment of a liquid crystal display apparatus according to this invention.

Referring to FIG. 6, the fourth preferred embodiment of an LCD apparatus according to this invention is shown to differ from the first preferred embodiment in that, in the fourth preferred embodiment, for each of the data voltage generating units 42 (only one is shown in FIG. 6), the operational amplifier (OP) is operable to generate the output voltage having a magnitude that is related to the input voltage received by the operational amplifier (OP), and includes a cascade of amplifying circuits (A1-A(n)), each of which is operable to output the output voltage according to a bias current generated by a current source (IS) to which the amplifying circuit (A1-A(n)) is operatively associated. The slew rate of the output voltage thus generated is in a positive relation to a magnitude of the bias current generated by the current source (IS) of each amplifying circuit (A1-A(n)).

The bias voltage generating unit 41 is connected electrically to the current source (IS) of each of the amplifying circuits (A1-A(n)) of each of the operational amplifiers (OP) in a current mirror configuration, receives the latch pulse signal (TP), and is operable to generate the input bias current and to control generation of the bias currents of the current sources (IS) of the amplifying circuits (A1-A(n)) of each of the operational amplifiers (OP) according to the latch pulse signal (TP).

In the current mirror configuration, the input bias current, and hence the bias current corresponding to each of the amplifying circuits (A1-A(n)) of each of the operational amplifiers (OP), correspond to the first predetermined current when the input bias current is at the low logic level, and correspond to the sum of the first predetermined current and the second predetermined current when the input bias current is at the high logic level.

For each of the operational amplifiers (OP), since the slew rate of the output voltage corresponds to the magnitude of the input bias current, the slew rate of the output voltage is higher when the input bias current is at the high logic level than when the input bias current is at the low logic level.

In summary, by virtue of the second current source (IS2) of the bias voltage generating unit 41, the effect of current boosting may be achieved without the need of implementing an additional current source in each of the operational amplifiers (OP), thereby reducing chip dimensions and hence manufacturing cost. Furthermore, as can be understood from FIG. 3, when the input bias current is at the high logic level, the output voltage generated by the operational amplifier (OP) of each of the data voltage generating units 42 is relatively stable and non-oscillatory, and the slew rate of the output voltage thus generated is increased.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A liquid crystal display (LCD) apparatus comprising:

an LCD panel having a plurality of pixel units, each of which includes a pixel capacitor, and a thin-film transistor (TFT) having a source terminal disposed to receive a data voltage, a gate terminal disposed to receive a gate voltage, and a drain terminal connected electrically to ground via said pixel capacitor; and a panel driving device including a timing control circuit operable for generating a gate control signal and a latch pulse signal, a gate driving circuit connected electrically to said timing control circuit for receiving the gate control signal therefrom, operable to generate a plurality of the gate voltages according to the gate control signal received by said gate driving circuit, and further connected electrically to said LCD panel for providing each of the gate voltages to said gate terminal of said TFT of a respective one of said pixel units, and a source driving circuit including a plurality of data voltage generating units, each of which includes an operational amplifier including a differential amplifier stage that is disposed to receive a bias current and an input voltage, and that is operable to generate an output voltage according to the bias current and the input voltage received by said differential amplifier stage, the output voltage generated by said differential amplifier stage of said operational amplifier of each of said data voltage generating units having a magnitude that corresponds to the input voltage received by said differential amplifier stage, and a slew rate that corresponds to a magnitude of the bias current, the data voltage received by said TFT of each of said pixel units of said LCD panel corresponding to the output voltage generated by said differential amplifier stage of said operational amplifier of a corresponding one of said data voltage generating units, and a current source that is controllable to generate the bias current and that is connected electrically to said differential amplifier stage for providing the bias current thereto, and a bias voltage generating unit connected electrically to said timing control circuit for receiving the latch pulse signal therefrom, and to said operational amplifier of each of said data voltage generating units in a current mirror configuration for generating an input bias current and controlling said current source of said operational amplifier to generate the bias current according to the latch pulse signal received by said bias voltage generating unit;

wherein the slew rate of the output voltage of said differential amplifier stage of said operational amplifier of each of said data voltage generating units is higher when the input bias current is at one of high and low logic states than when the input bias current is at the other of the high and low logic states.

2. The LCD apparatus as claimed in claim 1, wherein each of said data voltage generating units further includes a switch having a first terminal that is connected electrically to said differential amplifier stage of said operational amplifier for receiving the output voltage therefrom, a second terminal that is connected electrically to said source terminal of said TFT of the corresponding one of said pixel units, and a control terminal that receives the latch pulse signal from said timing control circuit, said switch of each of said data voltage generating units switching between conductive and non-conductive states according to the latch pulse signal received thereby such that the output voltage through said switch serves as the data voltage of the corresponding one of said pixel units of said LCD panel when said switch is in the conductive state.

3. The LCD apparatus as claimed in claim 1, wherein said current source of said operational amplifier of each of said data voltage generating units includes:

a first transistor having a first terminal that is connected electrically to said differential amplifier stage, a second terminal that is disposed to receive an input bias voltage, and a control terminal that is disposed to receive a first bias voltage corresponding to the input bias current from said bias voltage generating unit; and a second transistor having a first terminal that is connected electrically to said differential amplifier stage, a grounded second terminal, and a control terminal that is disposed to receive a second bias voltage from said bias voltage generating unit.

4. The LCD apparatus as claimed in claim 3, wherein said bias voltage generating unit includes:

a third transistor having a first terminal that is connected electrically to said control terminal of said first transistor of said current source of said operational amplifier of each of said data voltage generating units, a second terminal that is disposed to receive a terminal bias voltage, and a control terminal that is connected electrically to said first terminal of said third transistor;

a fourth transistor having a first terminal that is connected electrically to said control terminal of said second transistor of said current source of said operational amplifier of each of said data voltage generating units, a grounded second terminal, and a control terminal that is connected electrically to said first terminal of said fourth transistor;

a first current source connected electrically between said first terminal of said third transistor and said first terminal of said fourth transistor; and a series connection of a current-boost switch and a second current source connected electrically across said first current source, said current-boost switch having a control terminal that receives the latch pulse signal from said timing control circuit, said current-boost switch switching between conductive and non-conductive states according to the latch pulse signal received thereby.

5. A panel driving device for use with a liquid crystal display (LCD) panel having a plurality of pixel units, each of which includes a pixel capacitor and a thin-film transistor (TFT) having a source terminal that is disposed to receive a data voltage, a gate terminal that is disposed to receive a gate voltage, and a drain terminal that is connected electrically to ground via the pixel capacitor, said panel driving device comprising:

a timing control circuit operable for generating a gate control signal and a latch pulse signal;

a gate driving circuit connected electrically to said timing control circuit for receiving the gate control signal therefrom, operable to generate a plurality of the gate voltages according to the gate control signal received by said gate driving circuit, and adapted to be connected electrically to the LCD panel for providing each of the gate voltages to the gate terminal of the TFT of a respective one of the pixel units; and a source driving circuit including a plurality of data voltage generating units, each of which includes an operational amplifier including a differential amplifier stage that is disposed to receive a bias current and an input voltage, and that is operable to generate an output voltage according to the bias current and the input voltage received by said differential amplifier stage, the output voltage generated by said differential amplifier stage of said operational amplifier of each of said data voltage generating units having a magnitude that corresponds to the input voltage received by said differential amplifier stage, and a slew rate that corresponds to a magnitude of the bias current, the data voltage received by the TFT of each of the pixel units of the LCD panel corresponding to the output voltage generated by said differential amplifier stage of said operational amplifier of a corresponding one of said data voltage generating units, and a current source that is controllable to generate the bias current and that is connected electrically to said differential amplifier stage for providing the bias current thereto, and a bias voltage generating unit connected electrically to said timing control circuit for receiving the latch pulse signal therefrom, and to said operational amplifier of each of said data voltage generating units in a current mirror configuration for generating an input bias current and controlling said current source of said operational amplifier to generate the bias current according to the latch pulse signal received by said bias voltage generating unit;

wherein the slew rate of the output voltage of said differential amplifier stage of said operational amplifier of each of said data voltage generating units is higher when the input bias current is at one of high and low logic states than when the input bias current is at the other of the high and low logic states.

6. The panel driving device as claimed in claim 5, wherein each of said data voltage generating units further includes a switch having a first terminal that is connected electrically to said differential amplifier stage of said operational amplifier for receiving the output voltage therefrom, a second terminal that is adapted to be connected electrically to the source terminal of the TFT of the corresponding one of the pixel units, and a control terminal that receives the latch pulse signal from said timing control circuit, said switch of each of said data voltage generating units switching between conductive and non-conductive states according to the latch pulse signal received thereby such that the output voltage through said switch serves as the data voltage of the corresponding one of the pixel units of the LCD panel when said switch is in the conductive state.

7. The panel driving device as claimed in claim 5, wherein said current source of said operational amplifier of each of said data voltage generating units includes:

a first transistor having a first terminal that is connected electrically to said differential amplifier stage, a second terminal that is disposed to receive an input bias voltage, and a control terminal that is disposed to receive a first bias voltage corresponding to the input bias current from said bias voltage generating unit; and a second transistor having a first terminal that is connected electrically to said differential amplifier stage, a grounded second terminal, and a control terminal that is disposed to receive a second bias voltage from said bias voltage generating unit.

8. The panel driving device as claimed in claim 7, wherein said bias voltage generating unit includes:

a third transistor having a first terminal that is connected electrically to said control terminal of said first transistor of said current source of said operational amplifier of each of said data voltage generating units, a second terminal that is disposed to receive a terminal bias voltage, and a control terminal that is connected electrically to said first terminal of said third transistor;

a fourth transistor having a first terminal that is connected electrically to said control terminal of said second transistor of said current source of said operational amplifier of each of said data voltage generating units, a grounded second terminal, and a control terminal that is connected electrically to said first terminal of said fourth transistor;

a first current source connected electrically between said first terminal of said third transistor and said first terminal of said fourth transistor; and a series connection of a current-boost switch and a second current source connected electrically across said first current source, said current-boost switch having a control terminal that receives the latch pulse signal from said timing control circuit, said current-boost switch switching between conductive and non-conductive states according to the latch pulse signal received thereby.

9. A source driving circuit for use with a liquid crystal display (LCD) panel having a plurality of pixel units, each of which includes a pixel capacitor, and a thin-film transistor (TFT) having a source terminal that is disposed to receive a data voltage, said source driving circuit comprising:

a plurality of data voltage generating units, each of which includes an operational amplifier including a differential amplifier stage that is disposed to receive a bias current and an input voltage, and that is operable to generate an output voltage according to the bias current and the input voltage received by said differential amplifier stage, the output voltage generated by said differential amplifier stage of said operational amplifier of each of said data voltage generating units having a magnitude that corresponds to the input voltage received by said differential amplifier stage, and a slew rate that corresponds to a magnitude of the bias current, the data voltage received by the TFT of each of the pixel units of the LCD panel corresponding to the output voltage generated by said differential amplifier stage of said operational amplifier of a corresponding one of said data voltage generating units, and a current source that is controllable to generate the bias current and that is connected electrically to said differential amplifier stage for providing the bias current thereto; and a bias voltage generating unit disposed to receive a latch pulse signal, and connected electrically to said operational amplifier of each of said data voltage generating units in a current mirror configuration for generating an input bias current and controlling said current source of said operational amplifier to generate the bias current according to the latch pulse signal received by said bias voltage generating unit;

wherein the slew rate of the output voltage of said differential amplifier stage of said operational amplifier of each of said data voltage generating units is higher when the input bias current is at one of high and low logic states than when the input bias current is at the other of the high and low logic states.

10. The source driving circuit as claimed in claim 9, wherein each of said data voltage generating units further includes a switch having a first terminal that is connected electrically to said differential amplifier stage of said operational amplifier for receiving the output voltage therefrom, a second terminal that is adapted to be connected electrically to the source terminal of the TFT of the corresponding one of the pixel units, and a control terminal that is disposed to receive the latch pulse signal, said switch of each of said data voltage generating units switching between conductive and non-conductive states according to the latch pulse signal received thereby such that the output voltage through said switch serves as the data voltage of the corresponding one of the pixel units of the LCD panel when said switch is in the conductive state.

11. The source driving circuit as claimed in claim 9, wherein said current source of said operational amplifier of each of said data voltage generating units includes:

a first transistor having a first terminal that is connected electrically to said differential amplifier stage, a second terminal that is disposed to receive an input bias voltage, and a control terminal that is disposed to receive a first bias voltage corresponding to the input bias current from said bias voltage generating unit; and a second transistor having a first terminal that is connected electrically to said differential amplifier stage, a grounded second terminal, and a control terminal that is disposed to receive a second bias voltage from said bias voltage generating unit.

12. The source driving circuit as claimed in claim 11, wherein said bias voltage generating unit includes:

a third transistor having a first terminal that is connected electrically to said control terminal of said first transistor of said current source of said operational amplifier of each of said data voltage generating units, a second terminal that is disposed to receive a terminal bias voltage, and a control terminal that is connected electrically to said first terminal of said third transistor;

a fourth transistor having a first terminal that is connected electrically to said control terminal of said second transistor of said current source of said operational amplifier of each of said data voltage generating units, a grounded second terminal, and a control terminal that is connected electrically to said first terminal of said fourth transistor;

a first current source connected electrically between said first terminal of said third transistor and said first terminal of said fourth transistor; and a series connection of a current-boost switch and a second current source connected electrically across said first current source, said current-boost switch having a control terminal that is disposed to receive the latch pulse signal, said current-boost switch switching between conductive and non-conductive states according to the latch pulse signal received thereby.

13. A source driving circuit comprising:

a plurality of data voltage generating units, each of which includes an operational amplifier disposed to receive an input voltage and operable to generate an output voltage that has a magnitude related to the input voltage, said operational amplifier including a cascade of amplifying circuits, each of said amplifying circuits including a current source that is operable for providing a bias current, the output voltage of said operational amplifier having a slew rate that corresponds to a magnitude of said bias current; and a bias voltage generating unit connected electrically to said current source of each of said amplifying circuits of each of said operational amplifiers in a current mirror configuration, and operable to generate an input bias current and to control generation of the bias currents of said current sources of said amplifying circuits according to a latch pulse signal;

wherein a slew rate of the output voltage of each of said operational amplifiers is higher when the input bias current generated by said bias voltage generating unit is at one of high and low logic states than when the input bias current is at the other of the high and low logic states.

* * * * *